US009542887B2

(12) United States Patent
Pyo

(10) Patent No.: US 9,542,887 B2
(45) Date of Patent: Jan. 10, 2017

(54) ORGANIC LIGHT EMITTING DISPLAY DEVICE AND METHOD OF DRIVING AN ORGANIC LIGHT EMITTING DISPLAY DEVICE

(71) Applicant: SAMSUNG DISPLAY CO., LTD., Yongin, Gyeonggi-Do (KR)

(72) Inventor: Si-Baek Pyo, Cheonan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 42 days.

(21) Appl. No.: 14/547,043

(22) Filed: Nov. 18, 2014

(65) Prior Publication Data

US 2015/0279274 A1 Oct. 1, 2015

(30) Foreign Application Priority Data

Mar. 31, 2014 (KR) ..... 10-2014-0037385

(51) Int. Cl.
*G09G 3/32* (2016.01)

(52) U.S. Cl.
CPC .... *G09G 3/3233* (2013.01); *G09G 2310/0202* (2013.01)

(58) Field of Classification Search
CPC ..... G09G 3/3233; G09G 2310/0202; G09G 3/30–3/3291
USPC ..... 345/76–83, 204, 690; 315/169.3
See application file for complete search history.

(56) References Cited

U.S. PATENT DOCUMENTS

2006/0244387 A1* 11/2006 Park ..... G09G 3/3233 315/169.1
2007/0205969 A1* 9/2007 Hagood ..... G02B 26/004 345/84
2009/0322733 A1 12/2009 Park
2013/0127923 A1 5/2013 An et al.
2013/0169693 A1 7/2013 Pyo
2013/0176349 A1 7/2013 Park et al.
2013/0194316 A1 8/2013 Park et al.
2013/0321485 A1 12/2013 Eom et al.
2014/0375624 A1* 12/2014 Kanoh ..... G09G 5/18 345/213

FOREIGN PATENT DOCUMENTS

CN 103198779 A 7/2013
KR 10-2008-0028601 4/2008
KR 10-2013-0055256 5/2013
KR 10-2013-0136338 12/2013

(Continued)

*Primary Examiner* — Stephen Sherman
(74) *Attorney, Agent, or Firm* — Lewis Roca Rothgerber Christie LLP

(57) ABSTRACT

An organic light emitting diode display device including: a display panel including a plurality of pixels, a scan driving unit configured to supply a scan signal to the pixels via a plurality of scan lines, a data driving unit configured to supply a data signal to the pixels via a plurality of data lines, an emission driving unit configured to supply an emission control signal to the pixels via a plurality of emission control lines, and a timing control unit configured to control the scan driving unit, the data driving unit, and the emission driving unit, and to control the emission driving unit to gradually change an off-period of the emission control signal each time a number of image frames are displayed.

20 Claims, 11 Drawing Sheets

(56) References Cited

FOREIGN PATENT DOCUMENTS

| | | |
|---|---|---|
| KR | 10-2015-0010807 | 1/2015 |
| KR | 10-2015-0040095 | 4/2015 |
| KR | 10-2015-0056940 | 5/2015 |
| KR | 10-2015-0081803 | 7/2015 |
| TW | 101115869 | 5/2012 |
| TW | 201329954 | 7/2013 |

* cited by examiner

ORGANIC LIGHT EMITTING DISPLAY DEVICE AND METHOD OF DRIVING AN ORGANIC LIGHT EMITTING DISPLAY DEVICE

CROSS REFERENCE TO RELATED APPLICATION

This application claims priority to and the benefit of Korean Patent Application No. 10-2014-0037385 filed on Mar. 31, 2014, the disclosure of which is incorporated by reference herein in its entirety.

BACKGROUND

1. Field

Example embodiments of the present invention relate to display devices. More particularly, example embodiments of the present invention relate to organic light emitting display devices and methods of driving the organic light emitting display devices.

2. Description of the Related Art

Flat panel display (FPD) devices are widely used as display devices of electronic devices because the flat panel display device is lightweight and thin compared to a cathode-ray tube (CRT) display device. Typical examples of the flat panel display device are a liquid crystal display (LCD) device and an organic light emitting diode (OLED) display device. Compared to the liquid crystal display device, the organic light emitting display device has many advantages such as a higher luminance and a wider viewing angle. In addition, the organic light emitting display device can be made thinner because the organic light emitting display device does not require a backlight. In the organic light emitting display device, electrons and holes are injected into an organic thin layer through a cathode and an anode, and then recombined in the organic thin layer to generate excitons, thereby a light of a certain wavelength can be emitted.

When a moving image is displayed in the OLED display device, a motion blur phenomenon, by which an outline of an object becomes blurred or indistinct, can occur. To prevent the motion blur phenomenon, an impulse driving method is developed. In the impulse driving method, the image is displayed during a portion of one frame, and a black color is displayed during the remaining portion of the frame. However, in a high luminance (e.g., over about 250 nit) mode, when the impulse driving method is used (e.g., utilized), the utilization of the impulse driving method is restricted because an average luminance of the OLED display device is decreased. Accordingly, in the high luminance mode, an electric power consumption of the OLED display device may be increased.

SUMMARY

Aspects of some embodiments according to the present invention are directed toward an organic light emitting diode display device capable of reducing electric power consumption in a high luminance mode.

Aspects of some embodiments according to the present invention are directed to a method of driving an organic light emitting diode display device capable of reducing electric power consumption in a high luminance mode.

According to some example embodiments of the present invention, there is provided an organic light emitting diode display device including: a display panel including a plurality of pixels; a scan driving unit configured to supply a scan signal to the pixels via a plurality of scan lines; a data driving unit configured to supply a data signal to the pixels via a plurality of data lines; an emission driving unit configured to supply an emission control signal to the pixels via a plurality of emission control lines; and a timing control unit configured to control the scan driving unit, the data driving unit, and the emission driving unit, and to control the emission driving unit to gradually change an off-period of the emission control signal each time a number of image frames are displayed.

In an embodiment, the emission driving unit is configured to gradually increase the off-period of the emission control signal from a minimum off-period to a maximum off-period.

In an embodiment, the emission driving unit is further configured to gradually decrease the off-period of the emission control signal from the maximum off-period to the minimum off-period.

In an embodiment, the emission driving unit is further configured to periodically repeat the gradual increase and the gradual decrease of the off-period of the emission control signal.

In an embodiment, the emission driving unit is further configured to gradually increase and gradually decrease the off-period of the emission control signal when an average luminance of the organic light emitting diode display device is higher than about 200 nit.

In an embodiment, the emission driving unit is further configured to perform each of the gradual increase and the gradual decrease of the off-period of the emission control signal for more than about 10 seconds.

In an embodiment, the maximum off-period is below about 10% of one frame time.

In an embodiment, the pixels are configured to sequentially emit light on a row-by-row basis.

In an embodiment, the device further includes: a frame memory unit configured to store frame data; and a stop image sensing unit configured to determine when the frame data stored in the frame memory unit represent a stop image.

In an embodiment, the emission driving unit is further configured to maintain the off-period of the emission control signal at a maximum off-period, when the stop image sensing unit determines that the frame data represent the stop image.

According to some example embodiments of the present invention, there is provided a method of driving an organic light emitting diode display device including a plurality of pixels, the method including: generating an emission control signal to allow the pixels to emit light; and gradually changing an off-period of the emission control signal each time a number of image frames are displayed.

In an embodiment, the off-period of the emission control signal is gradually increased from a minimum off-period to a maximum off-period.

In an embodiment, when the off-period of the emission control signal reaches the maximum off-period, the off-period of the emission control signal is gradually decreased from the maximum off-period to the minimum off-period.

In an embodiment, the gradual increase and the gradual decrease of the off-period of the emission control signal are periodically repeated.

In an embodiment, the gradual increase and the gradual decrease of the off-period of the emission control signal are performed when an average luminance of the organic light emitting diode display device is greater than about 200 nit.

In an embodiment, each of the gradual increase and the gradual decrease of the off-period of the emission control signal is performed for more than about 10 seconds.

In an embodiment, the maximum off-period is below about 10% of one frame time.

In an embodiment, the pixels sequentially emit light on a row-by-row basis.

In an embodiment, the method of driving an organic light emitting diode display device further includes: storing frame data in a frame memory unit; and determining, by a stop image sensing unit, when the frame data stored in the frame memory unit represent a stop image.

In an embodiment, when the stop image sensing unit determines that the frame data represent the stop image, the off-period of the emission control signal is maintained at a maximum off-period.

As the organic light emitting diode display device, according to some example embodiments, gradually increases and gradually decreases the emission control signal, an electric power consumption of the organic light emitting diode display device may be decreased in the high luminance mode.

In addition, as the method of driving the organic light emitting diode display device, according to some example embodiments, gradually increases and gradually decreases the emission control signal, an electric power consumption of the organic light emitting diode display device may be decreased in the high luminance mode.

BRIEF DESCRIPTION OF THE DRAWINGS

Example embodiments of the present invention can be understood in more detail from the following description taken in conjunction with the accompanying drawings, in which.

DETAILED DESCRIPTION

Figure 1:
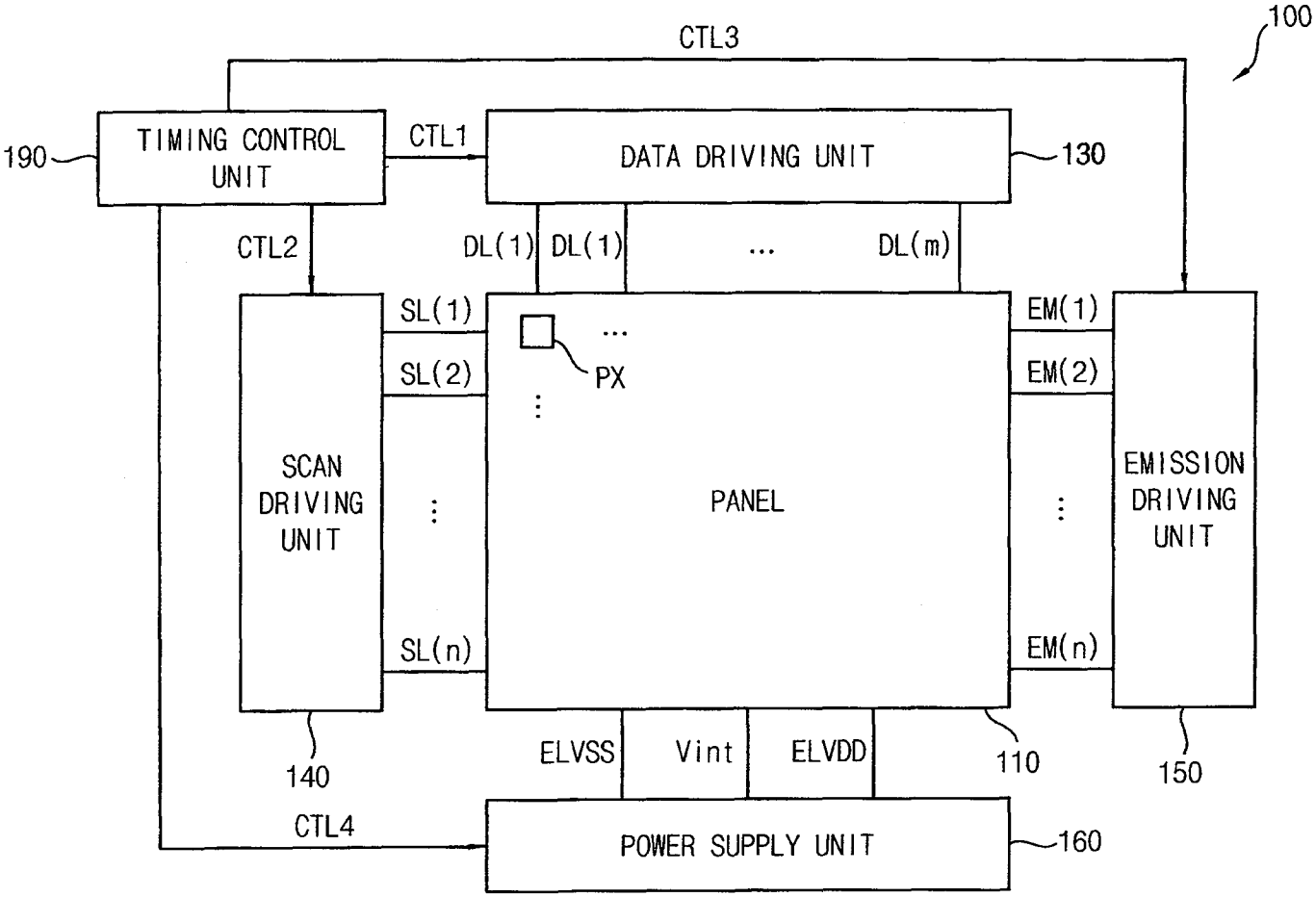
FIG. 1 is a block diagram illustrating an organic light emitting diode display device in accordance with an example embodiment of the present invention.

Hereinafter, example embodiments of the invention will be described in detail with reference to the accompanying drawings. In the drawings, identical or similar reference numerals may represent identical or similar elements.

In the following description, expressions such as "at least one of," when preceding a list of elements, modify the entire list of elements and do not modify the individual elements of the list. Further, the use of "may" when describing embodiments of the present invention refers to "one or more embodiments of" the present invention. When a first element is described as being "coupled" or "connected" to a second element, the first element may be directly "coupled" or "connected" to the second element, or one or more other intervening elements may be located between the first element and the second element. The term "gradual" may refer to a smooth transition over time, unlike the sudden transition of a step function.

FIG. 1 is a block diagram illustrating an organic light emitting diode display device in accordance with an example embodiment of the present invention.

Referring to FIG. 1, an organic light emitting diode (OLED) display device 100 includes a display panel 110, a data driving unit 130, a scan driving unit 140, an emission driving unit 150, a power supply unit 160, and a timing control unit 190.

The display panel 110 is coupled to the scan driving unit 140 via scan-lines SL(1) through SL(n), and is coupled to the data driving unit 130 via data-lines DL(1) through DL(m). In addition, the display panel 110 is coupled to the emission driving unit 150 via emission control lines EM(1) through EM(n). Further, the display panel 110 may include n*m pixels PX because the pixels PX are arranged at locations corresponding to crossing points (e.g., crossing regions) of the scan-lines SL(1) through SL(n) and the data-lines DL(1) through DL(m). In some example embodiments, the display panel 110 may be manufactured based on an RGB-OLED technology. For example, a first data signal that is applied to the first data line DL(1) may be referred to as a red color data signal, and pixels PX that are coupled to (e.g., connected to) the first data line DL(1) may be referred to as red color pixels PX. A second data signal that is applied to the second data line DL(2) may be referred to as a green color data signal, and pixels PX that are coupled to the second data line DL(2) may be referred to as green color pixels PX. A third data signal that is applied to the third data line DL(3) may be referred to as a blue color data signal, and pixels PX that are coupled to the third data line DL(3) may be referred to as blue color pixels PX. However, the present invention is not limited thereto.

For example, respective color lights emitted by the pixels PX may be selected from among the red color light, the green color light, and the blue color light in various suitable ways. In some example embodiments, the display panel 110 may be manufactured based on a WRGB-OLED technology. For example, a first data signal that is applied to the first data line DL(1) may be referred to as a red color data signal, and pixels PX that are coupled to the first data line DL(1) may be referred to as red color pixels PX. A second data signal that is applied to the second data line DL(2) may be referred to as a green color data signal, and pixels PX that are coupled to the second data line DL(2) may be referred to as green color pixels PX. A third data signal that is applied to the third data line DL(3) may be referred to as a blue color data signal, and pixels PX that are coupled to the third data line DL(3) may be referred to as blue color pixels PX. A fourth data signal that is applied to the fourth data line DL(4) may be referred to as a white color data signal, and pixels PX that are coupled to the fourth data line DL(4) may be referred to as white color pixels PX. However, the present invention is not limited thereto. For example, respective color lights emitted by the pixels PX may be selected from among the white color light, the red color light, the green color light, and the blue color light in various suitable ways.

The data driving unit 130 may provide (e.g., supply) a data signal to each of the pixels PX via the data-lines DL(1) through DL(m). In some example embodiments, the data driving unit 130 may selectively generate the first through third data signals in response to a first timing control signal CTL1 of the timing control unit 190, and the data driving unit 130 may selectively apply the first through third data signals to the display panel 110 by the first timing control signal CTL1 of the timing control unit 190. For example, the first data signal may correspond to a signal that is related to the red color pixels PX emitting the red color light, the second data signal may correspond to a signal that is related to the green color pixels PX emitting the green color light, and the third data signal may correspond to a signal that is related to the blue color pixels PX emitting the blue color light. However, the present invention is not limited thereto. For example, according to required conditions for the OLED display device 100, respective color lights emitted by the pixels PX via the data signals may be selected from among the red color light, the green color light, and the blue color light in various suitable ways. In some example embodiments, the data driving unit 130 selectively generates first through fourth data signals in response to a first timing control signal CTL1 of the timing control unit 190, and the data driving unit 130 selectively applies the first through fourth data signals to the display panel 110 by the first timing control signal CTL1 of the timing control unit 190. For example, the first data signal may correspond to a signal that is related to the red color pixels PX emitting the red color light, the second data signal may correspond to a signal that is related to the green color pixels PX emitting the green color light, the third data signal may correspond to a signal that is related to the blue color pixels PX emitting the blue color light, and the fourth data signal may correspond to a signal that is related to the white color pixels PX emitting the white color light. However, the present invention is not limited thereto. For example, according to required conditions for the OLED display device 100, respective color lights emitted by the pixels PX via the data signals may be selected from among the white color light, the red color light, the green color light, and the blue color light in various suitable ways.

The scan driving unit 140 may provide (e.g., supply) a scan signal to each of the pixels PX via the scan-lines SL(1) through SL(n). The scan driving unit 140 may sequentially output a scan signal to the display panel 110 in response to a second timing control signal CTL2 of the timing control unit 190. For example, when the scan signal is outputted to a first scan line SL(1), the data signals may be applied to the pixels PX that are coupled to the first scan line SL(1), respectively. In addition, when the scan signal is outputted to a second scan line SL(2), the data signals may be applied to the pixels PX that are coupled to the second scan line SL(2), respectively.

The power supply unit 160 may provide (e.g., supply) a high power voltage ELVDD, a low power voltage ELVSS, and an initial voltage Vint to each of the pixels PX via power lines. The power supply unit 160 may be controlled in response to a fourth timing control signal CTL4.

The timing control unit 190 may generate first through fourth timing control signals CTL1, CTL2, CTL3, and CTL4. As the timing control unit 190 provides (e.g., generates) the first through fourth timing control signals CTL1, CTL2, CTL3, and CTL4 to the data driving unit 130, the scan driving unit 140, the emission driving unit 150, and the power supply unit 160, the timing control unit 190 may control the data driving unit 130, the scan driving unit 140, the emission driving unit 150, and the power supply unit 160. For example, as the timing control unit 190 provides (e.g., generates) the second timing control signal CTL2 to the scan driving unit 140, the timing control unit 190 may control the scan driving unit 140 such that the scan driving unit 140 sequentially outputs the scan signals to the display panel 110. In addition, as the timing control unit 190 provides (e.g., generates) the first timing control signal CTL1 to the data driving unit 130, the timing control unit 190 may control the data driving unit 130 such that the data driving unit 130 outputs each of the data signals corresponding to the pixel PX of the display panel 110. Further, as the timing control unit 190 provides (e.g., generates) the third timing control signal CTL3 to the emission driving unit 150, the timing control unit 190 may control the emission driving unit 150 such that the emission driving unit 150 outputs the emission control signals corresponding to the pixel PX of the display panel 110. Here, the third timing control signal CTL3 may control the emission driving unit 150 such that an off-period of the emission control signal is gradually changed (e.g., gradually increased and then gradually decreased) every set or predetermined number of frames. In other word, the third timing control signal CTL3 may control the emission driving unit 150 to change an off-period of the emission control signal each time a set or predetermined number of image frames are displayed such that the off-period of the emission control signal is gradually changed.

The emission driving unit 150 may provide (e.g., supply) the emission control signals to each of the pixels PX via an emission control lines EM(1) through EM(n). The emission control signals may be generated depending on the third timing control signal CTL3 such that the off-period is gradually changed every set or predetermined number of the frames. For example, the off-period of the emission control signals may be gradually increased and gradually decreased every set or predetermined number of the frames. An increase of the off-period and a decrease of the off-period may be periodically repeated.

Figure 2:
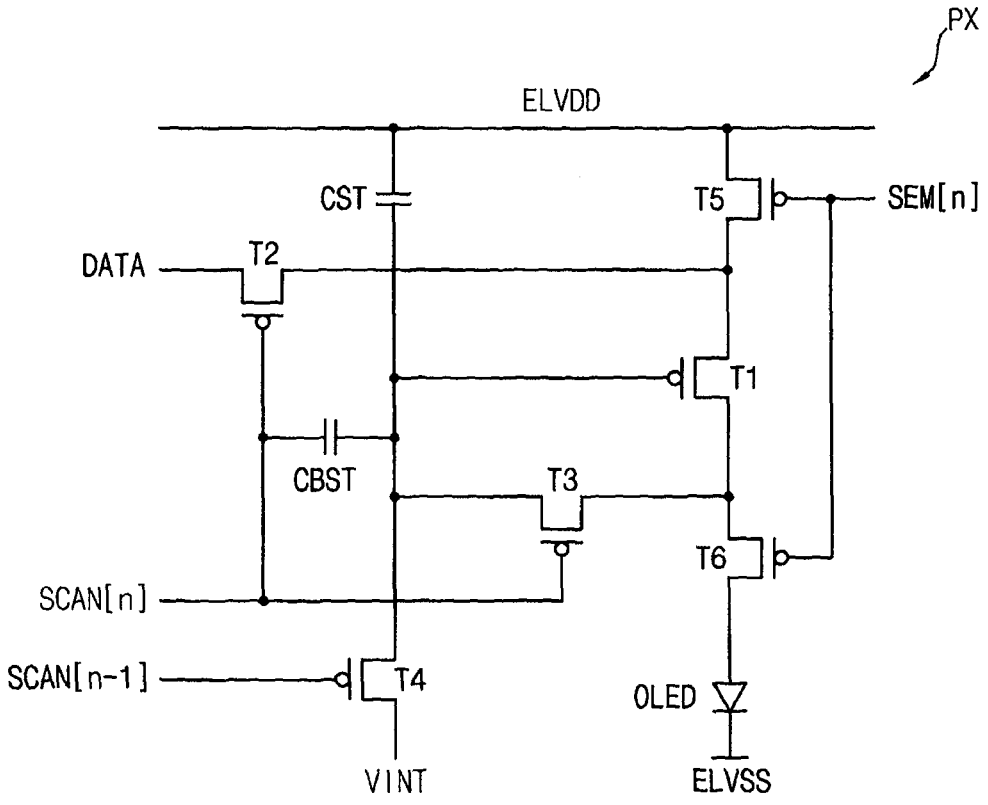
FIG. 2 is a circuit diagram illustrating an example of a pixel circuit that is included in a pixel of FIG. 1, according to an example embodiment of the present invention.

FIG. 2 is a circuit diagram illustrating an example of a pixel circuit that is included in a pixel of FIG. 1, according to an example embodiment of the present invention.

Referring to FIG. 2, a pixel circuit included in a pixel PX may include a first transistor TR1 (e.g., a driving transistor), a second transistor TR2, a third transistor TR3, a fourth transistor TR4, a fifth transistor TR5, a sixth transistor TR6, a first capacitor CST, a second capacitor CBST, etc. The first transistor TR1 may apply a driving current to an organic light emitting diode (OLED). Here, the driving current may correspond to a data signal DATA between a high power voltage ELVDD and of an anode electrode of the OLED.

The second transistor TR2 may be coupled to a data line corresponding to a source electrode of the first transistor TR1. The third transistor TR3 may be coupled between gate and drain electrodes of the first transistor TR1. The fourth transistor TR4 may be coupled between an initial voltage VINT and the gate electrode of the first transistor TR1. The fifth transistor TR5 may be coupled between the high power voltage ELVDD and a source electrode of the first transistor TR1. The sixth transistor TR6 may be coupled between the drain electrode of the first transistor TR1 and the anode electrode of the OLED. The first capacitor CST may be coupled between the initial voltage VINT and the high power voltage ELVDD. The second capacitor CBST may be coupled between a gate electrode of the second transistor TR2 and the initial voltage VINT.

In particular, a switching operation of the fourth transistor TR4 may be controlled according to a scan signal SCAN (n−1) generated by a scan driving unit. When the fourth transistor TR4 is turned on after the scan signal SCAN(n−1) is applied to all the pixels PX during an initial period of a frame (e.g., an initial predetermined period of a frame), the initial voltage VINT is applied to the gate electrode of the first transistor TR1, and then a voltage of the gate electrode of the first transistor TR1 may be reset to a voltage corresponding to the initial voltage VINT.

The second transistor TR2 may be turned on (e.g., activated) according to the scan signal SCAN(n) generated by a scan driving unit. The second transistor TR2 may apply a data signal DATA(m) to the first transistor TR1 via a data line.

The scan signal SCAN(n) is concurrently (e.g., simultaneously) applied to the gate electrode of the third transistor TR3 and the gate electrode of the second transistor TR2, and the third transistor TR3 is operated.

When the third transistor TR3 is turned on, the first transistor TR1 is coupled to the OLED. Here, a threshold voltage of the first transistor TR1 may be compensated. The same scan signal SCAN(n) is applied to each of the gate electrodes of the second transistor TR2 and the third transistor TR3, and thus the data signal may be applied to the pixel PX while the threshold voltage is compensated.

The first transistor TR1 may apply a driving current to the OLED. Here, the driving current may correspond to the data signal DATA(m) applied via the second transistor TR2.

The sixth transistor TR6 may be positioned between the drain electrode of the first transistor TR1 and the anode electrode of the OLED. Here, as the sixth transistor TR6 is applied to an emission control signal SEM(n), the sixth transistor TR6 may perform a switch role. For example, when the sixth transistor TR6 is turned on, the driving current corresponding to the data signal is applied to the OLED, and then an image is displayed. Thus, because an emission of the pixel PX may be controlled by controlling the emission control signal SEM(n) that is applied to the sixth transistor TR6, each of the frame cycles (e.g., frame periods) is divided into a plurality of periods having the same time interval. The periods of the applied emission control signal SEM(n) may have on-periods of different time intervals. For example, an off-period of the emission control signal SEM(n) may be gradually increased and decreased every set or predetermined number of frames. An increase of the off-period and a decrease of the off-period may be periodically repeated.

The pixel PX of FIG. 1 may include various suitable pixel circuits capable of controlling an emission of the OLED by being applied the emission control signal other than the pixel circuit of FIG. 2.

Figure 3:
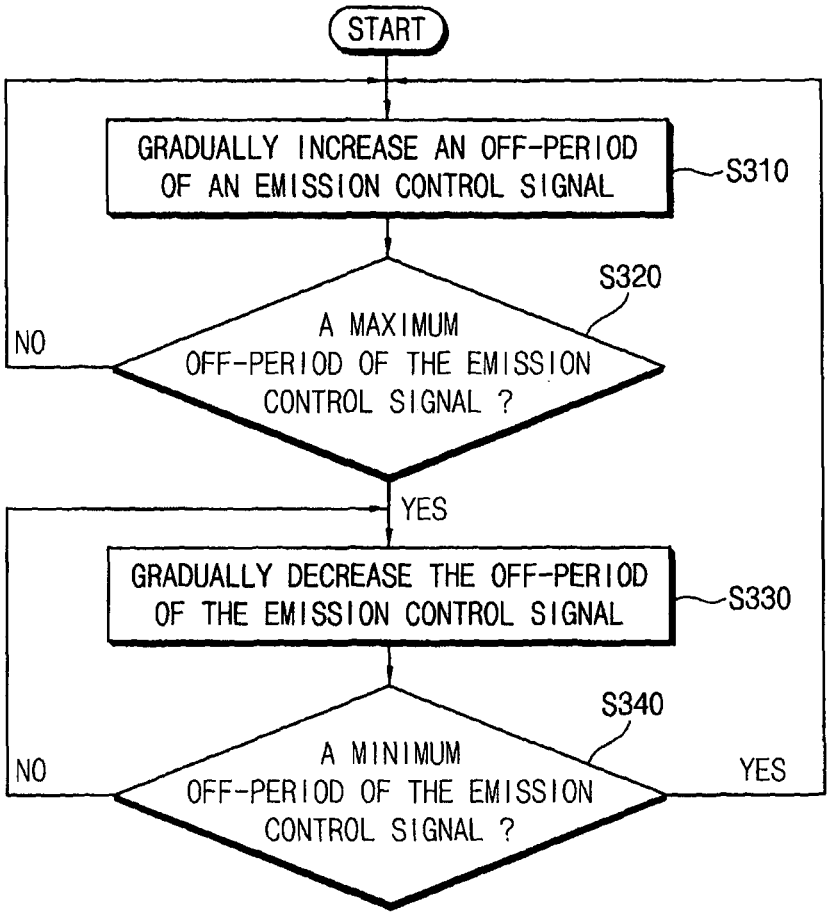
FIG. 3 is a flow diagram illustrating a method of driving an organic light emitting diode display device in accordance with an example embodiment of the present invention.

FIG. 3 is a flow diagram illustrating a method of driving an organic light emitting diode display device in accordance with an example embodiment of the present invention.

Referring to FIG. 3, in a method of driving an organic light emitting diode (OLED) display device 100 having a plurality of pixels emitting light in response to an emission control signal, the method of driving the OLED display device 100 of FIG. 3 may gradually increase an off-period of the emission control signal from a minimum off-period to a maximum off-period every set or predetermined number of frames (act S310). In addition, when the off-period of the emission control signal reaches the maximum off-period (act S320), the method of driving the OLED display device 100 may gradually decrease the off-period of the emission control signal from the maximum off-period to the minimum off-period every set or predetermined number of frames (act S330). Meanwhile, when the off-period of the emission control signal reaches the minimum off-period (act S340), a gradual increase of the off-period may be performed again (act S310). That is, a gradual increase of the off-period of the emission control signal and a gradual decrease of the off-period of the emission control signal may be periodically repeated. The maximum off-period may refer to an off-period that is about 10% of a frame, and the minimum off-period may refer to an off-period that is about 0.2% of a frame FIG. 4 is a waveform diagram illustrating an example of a change of an off-period of an emission controlling signal that is applied to an emission driving unit of FIG.1, according to an example embodiment of the present invention.

Figure 4:
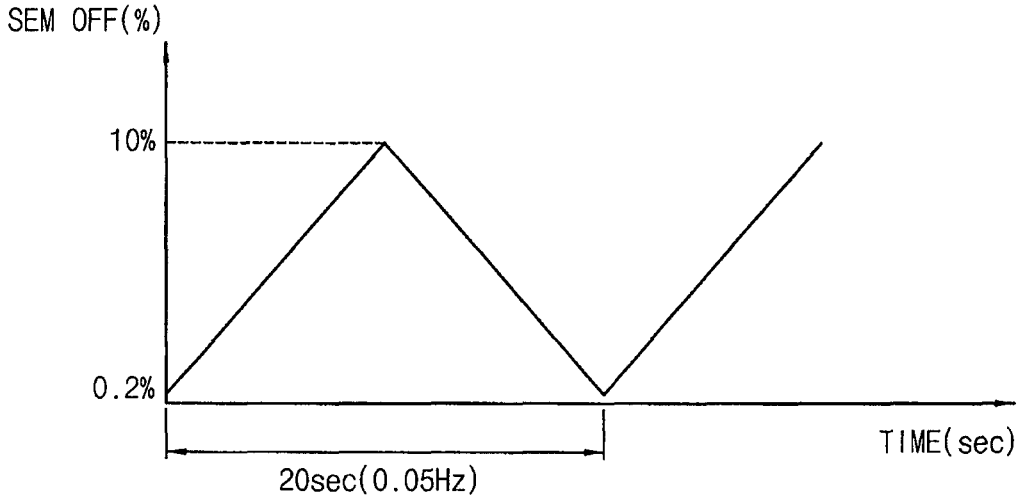
FIG. 4 is a waveform diagram illustrating an example of a change of an off-period of an emission control signal that is applied to an emission driving unit of FIG.1, according to an example embodiment of the present invention.

Referring to FIG. 4, a third timing control signal CTL3 may control the emission driving unit 150 such that an off-period of an emission control signal SEM(n) may be gradually increased and gradually decreased every set or predetermined number of frames. In addition, an increase of the off-period and a decrease of the off-period may be periodically repeated. In some example embodiments, the emission control signal SEM(n) may include the off-period. During the off-period, pixels PX may be maintained at an off state (e.g., turned off or deactivated). For example, the off-period (e.g., an off duty ratio) may be determined according to a luminance mode of the OLED display device 100 (e.g., a low luminance (about 5 nit to about 60 nit) mode, a middle luminance (about 64 nit to about 162 nit) mode, and a high luminance (about 172 nit to 350 nit) mode). Here, when the OLED display device 100 is in the high luminance mode, the off-period of the high luminance mode may be less than that of the low or middle luminance mode. For example, when the off-period becomes longer in the high luminance mode, a user of the OLED display device 100 may sense a luminance change. Thus, the off-period in the high luminance mode may have a value (e.g., a predetermined fixed value) of about 0.1% to about 0.3% of one frame. The value (e.g., the predetermined fixed value) may correspond to an amount of time that it takes to reset a voltage of a gate electrode of a first transistor TR1 to an initial voltage VINT after the initial voltage VINT is applied to the gate electrode of the first transistor TR1.

When the OLED display device 100, according to some example embodiments, is the high luminance mode, the off-period of the emission control signal SEM(n) based on the third timing control signal CTL3 may be maintained at 0.2% of 1 frame during one second (e.g., a minimum off-period). The third timing control signal CTL3 may gradually increase the off-period of the emission control signal SEM(n) by 1% per 1 second (e.g., a linearly increase). However, in an initial act (or task), it is increased by 0.8% per 1 second (e.g., increase from 0.2% to 1%). The third timing control signal CTL3 may gradually increase the off-period of the emission control signal SEM(n) up to 10% over 10 seconds (e.g., during 10 seconds). Here, when the off-period is increased to 10%, the off-period may be defined as a maximum off-period. For example, the maximum off-period may be determined by a user of the OLED display device 100 such that a momentary residual image is not sensed (e.g., perceived) by the user. When the off-period reaches the maximum off-period, the third timing control signal CTL3 may gradually decrease the off-period of the emission control signal SEM(n) by 1% per 1 second (e.g., linearly decrease). However, in a last act (or task), it is decreased by 0.8% per 1 second (e.g., decrease from 1% to 0.2%). The third timing control signal CTL3 may gradually decrease the off-period of the emission control signal SEM (n) up to 0.2% over 10 seconds. Here, when the off-period is decreased to 0.2%, the off-period may be defined as the minimum off-period. In some example embodiments, a cycle (e.g., a period) of the third timing control signal CTL3 controlling an increase and a decrease of the off-period may be 20 seconds (i.e., 0.05 Hz). When the off-period is gradually increased and gradually decreased every set or predetermined number of frames, each of the gradual increase and the gradual decrease of the off-period may be 10 seconds. For example, the cycle of the third timing control signal CTL3 may be a very low frequency (VLF) or an infrasonic (e.g., when the VLF is below 1 Hz). When the cycle of the third timing control signal CTL3 is the VLF (i.e., when the increase and the decrease of the off-period is performed in the VLF), the user of the OLED display device 100 may not sense a luminance change according to the increase and the decrease of the off-period. Thus, in the high luminance mode, as the off-period is gradually increased and gradually decreased every set or predetermined number of frames, an electric power consumption of the OLED display device 100 may be decreased in the high luminance mode.

Figure 5:
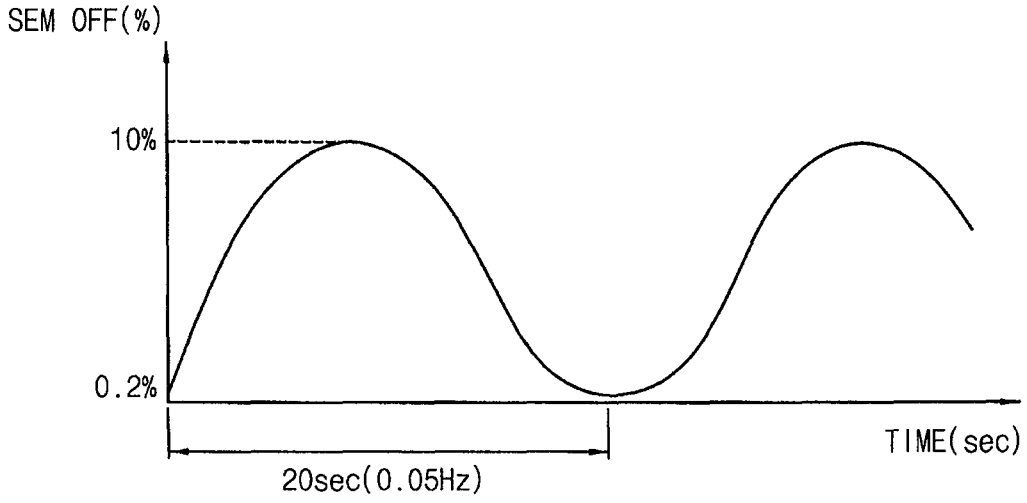
FIG. 5 is a waveform diagram illustrating an example of a change of an off-period of an emission control signal that is applied to an emission driving unit of FIG.1, according to an example embodiment of the present invention.

FIG. 5 is a waveform diagram illustrating an example of a change of an off-period of an emission controlling signal that is applied to an emission driving unit of FIG.1, according to an example embodiment of the present invention.

Referring to FIG. 5, a third timing control signal CTL3 may control such that an off-period of an emission control signal SEM(n) may be gradually increased and gradually decreased every set or predetermined number of frames. In other word, the third timing control signal CTL3 may control the emission driving unit 150 to change an off-period of the emission control signal each time a set or predetermined number of image frames are displayed such that the off-period of the emission control signal is gradually changed. In addition, an increase of the off-period and a decrease of the off-period may be periodically repeated.

In some example embodiments, when an organic light emitting diode (OLED) display device 100 is in the high luminance mode, the off-period of the emission control signal SEM(n) based on the third timing control signal CTL3 may be maintained at 0.2% of 1 frame during one second (e.g., a minimum off-period). The third timing control signal CTL3 may non-linearly increase the off-period of the emission control signal SEM(n) over time. For example, when the third timing control signal CTL3 increases the off-period of emission control signal SEM(n) up to 10% over 10 seconds, the off-period may be sharply increased from 1 to 5 seconds, and then the off-period may be gradually increased from 6 to 10 seconds (e.g., the change in the off-period may follow a shape of a Gaussian-like graph). Here, when the off-period is increased to 10%, the off-period may be defined as a maximum off-period. For example, the maximum off-period may be determined by a user of the OLED display device 100 such that a momentary residual image is not sensed (e.g., perceived) by the user. When the off-period reaches the maximum off-period, the third timing control signal CTL3 may non-linearly decrease the off-period of the emission control signal SEM(n) over time. The third timing control signal CTL3 may non-linearly decrease the off-period of the emission control signal SEM(n) up to 0.2% over 10 seconds. Here, when the off-period is decreased to 0.2%, the off-period may be defined as the minimum off-period.

As described above, as the OLED display device 100, according to some example embodiments, increases and decreases the off-period of the emission control signal SEM(n) every set or predetermined number of frames in the high luminance mode, an electric power consumption of the OLED display device 100 may be decreased.

FIGS. 6 through 9 are waveform diagrams illustrating examples of an emission controlling signal that is applied to a pixel of FIG.1, according to an example embodiment of the present invention.

Figure 6:
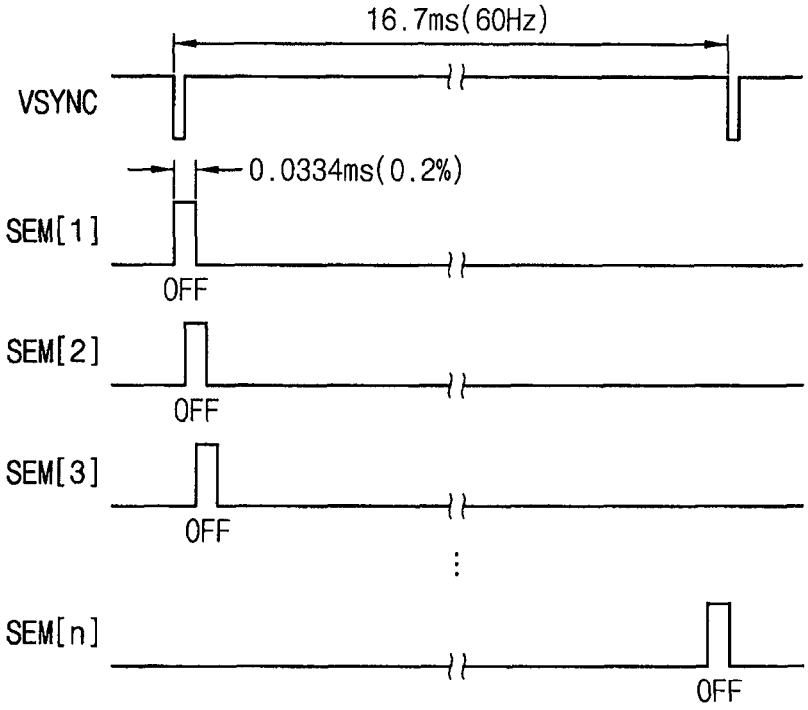
FIGS. 6 through 9 are waveform diagrams illustrating examples of an emission control signal that is applied to a pixel of FIG.1, according to some example embodiment of the present invention.

Referring to FIG. 6, an emission control signal SEM(n) may include at least one off-period. Pixels PX may be maintained at an off state (e.g., turned off or deactivated) during the off-period. When an organic light emitting diode (OLED) display device 100, according to some example embodiments, is in a high luminance mode, the off-period of the emission control signal SEM(n) based on a third timing control signal CTL3 may be maintained at 0.2% of 1 frame during 1 second (e.g., a minimum off-period). For example, when a cycle (e.g., a period) of 1 frame is 16.7 ms (i.e., a frequency of the frame is 60 Hz), the emission control signal SEM(n) may be a turned-off state during about 0.0334 ms. The emission control signals (SEM(1), SEM(2), through SEM(n)) having the off-period may be sequentially applied to a display panel 110.

Figure 7:
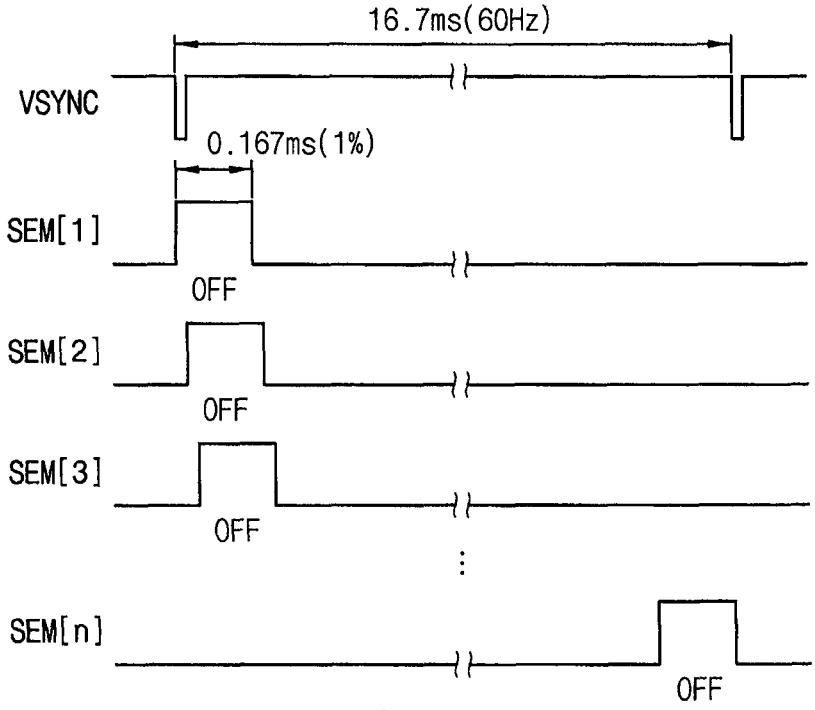

Referring to FIG. 7, when the OLED display device 100, according to some example embodiments, is a high luminance mode, the off-period of the emission control signal SEM(n) based on the third timing control signal CTL3 may be maintained at 1% of 1 frame during 1 second. For example, when a cycle of 1 frame is 16.7 ms (i.e., a frequency of the frame is 60 Hz), the emission control signal SEM(n) may be in a turned-off state during about 0.167 ms. The emission control signals (SEM(1), SEM(2), through SEM(n)) having the off-period may be sequentially applied to a display panel 110. The third timing control signal CTL3 may gradually increase the off-period of the emission control signal SEM(n) by 1% per 1 second (e.g., linearly increase the off-period over time). However, in an initial act, it is increased by 0.8% per 1 second (e.g., increase from 0.2% to 1%).

Figure 8:
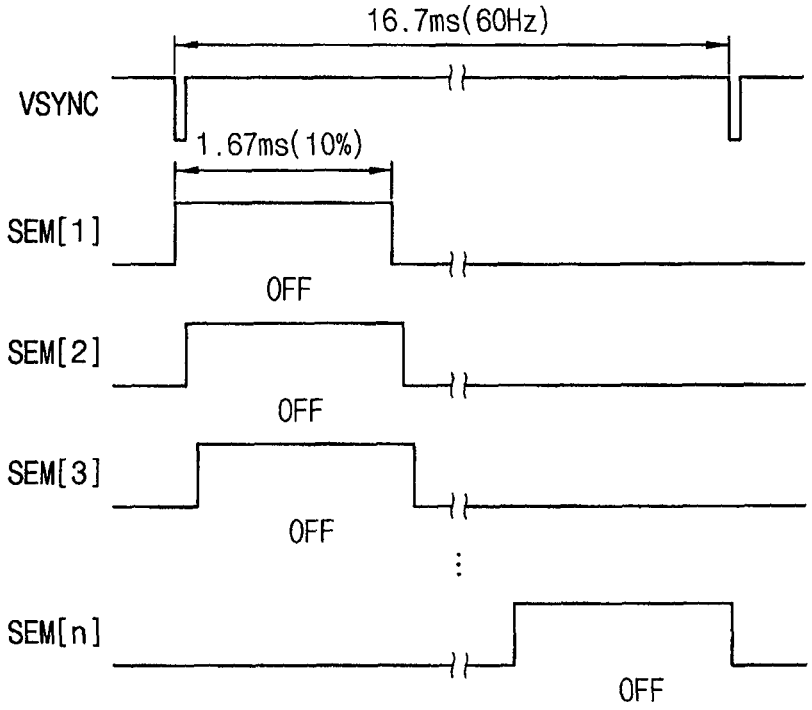

Referring to FIG. 8, the third timing control signal CTL3 may gradually increase the off-period of the emission control signal SEM(n) up to 10% over a period of (e.g., during) 10 seconds. In the high luminance mode, the off-period of the emission control signal SEM(n) based on the third timing control signal CTL3 may be maintained at 10% of 1 frame during one second (e.g., a maximum off-period). For example, when a cycle (e.g., a period) of 1 frame is 16.7 ms (i.e., a frequency of the frame is 60 Hz), the emission control signal SEM(n) may be in a turned-off state during about 1.67 ms. The emission control signals (SEM(1), SEM(2), through SEM(n)) having the off-period may be sequentially applied to a display panel 110. Here, when the off-period is increased to 10% (e.g., about 1.67 ms), the off-period may be defined as a maximum off-period. For example, the maximum off-period may be determined by a user of the OLED display device 100 such that a momentary residual image is not sensed by the user.

Figure 9:
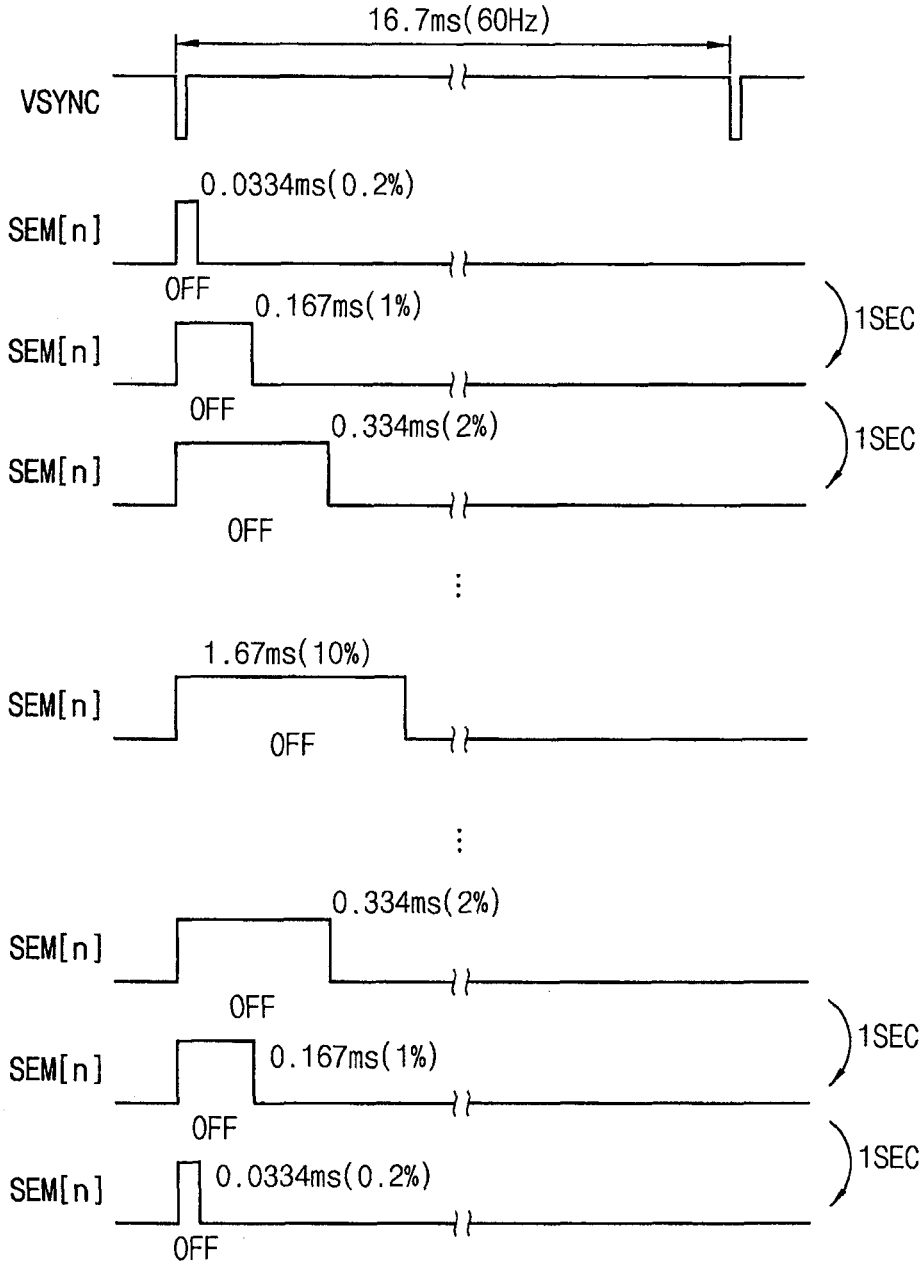

Referring to FIG. 9, when the off-period reaches the maximum off-period, the third timing control signal CTL3 may gradually decrease (e.g., linearly decrease) the off-period of the emission control signal SEM(n) by 1% per 1 second. However, in a last act, it is decreased by 0.8% per 1 second (e.g., decrease from 1% to 0.2%). The third timing control signal CTL3 may gradually decrease the off-period of the emission control signal SEM(n) up to 0.2% over a period of (e.g., during) 10 seconds. Here, when the off-period is decreased to 0.2%, the off-period may be defined as the minimum off-period. In some example embodiments, a cycle of the third timing control signal CTL3 controlling an increase and a decrease of the off-period may be 20 seconds (i.e., 0.05 Hz). When the off-period is gradually increased and gradually decreased every set or predetermined number of frames, each of the gradual increase and the gradual decrease of the off-period may be 10 seconds. For example, the cycle of the third timing control signal CTL3 may be a very low frequency (VLF) or an infrasonic (e.g., the VLF is below 1 Hz). When the cycle is increased and decreased in the VLF, the user of the OLED display device 100 may not sense a luminance change. Thus, in the high luminance mode, as the off-period is gradually increased and gradually decreased every set or predetermined number of frames, an electric power consumption of the OLED display device 100 may be decreased in the high luminance mode.

Figure 10:
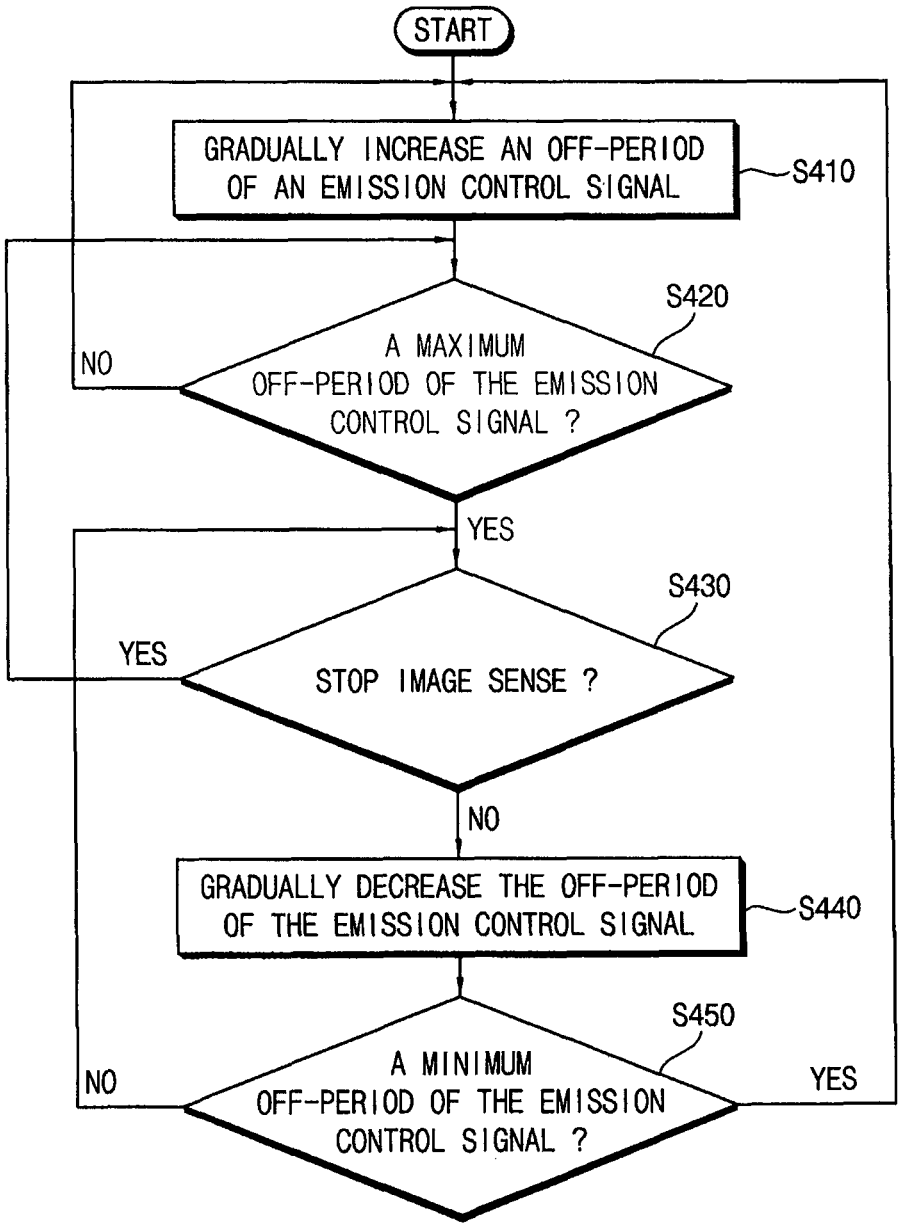
FIG. 10 is a flow diagram illustrating a method of driving an organic light emitting diode display device in accordance with an example embodiment of the present invention.

FIG. 10 is a flow diagram illustrating a method of driving an organic light emitting diode display device in accordance with an example embodiment of the present invention.

Referring to FIG. 10, in a method of driving an organic light emitting diode (OLED) display device 100 having a plurality of pixels emitting light in response to an emission control signal, the method of driving the OLED display device 100 of FIG. 10 may gradually increase an off-period of the emission control signal from a minimum off-period to a maximum off-period every set or predetermined number of frames (act S410). In addition, when the off-period of the emission control signal reaches the maximum off-period (act S420), a stop image sensing unit of the OLED display device 100 may determine whether or not the stored frame data (e.g., the frame data is stored in a frame memory unit) represent a stop image (act S430). When the stop image sensing unit determines that the frame data displays the stop image, the off-period of the emission control signal may be maintained at the maximum off-period. When the stop image sensing unit determines that the frame data does not display the stop image (e.g., a moving image), the method of driving the OLED display device 100 may gradually decrease the off-period of the emission control signal from the maximum off-period to the minimum off-period every set or predetermined number of frames (act S440). Meanwhile, when the off-period of the emission control signal reaches the minimum off-period (act S450), a gradual increase of the off-period may be performed again (act S410). That is, a gradual increase of the off-period of the emission control signal and a gradual decrease of the off-period of the emission control signal may be periodically repeated.

Figure 11:
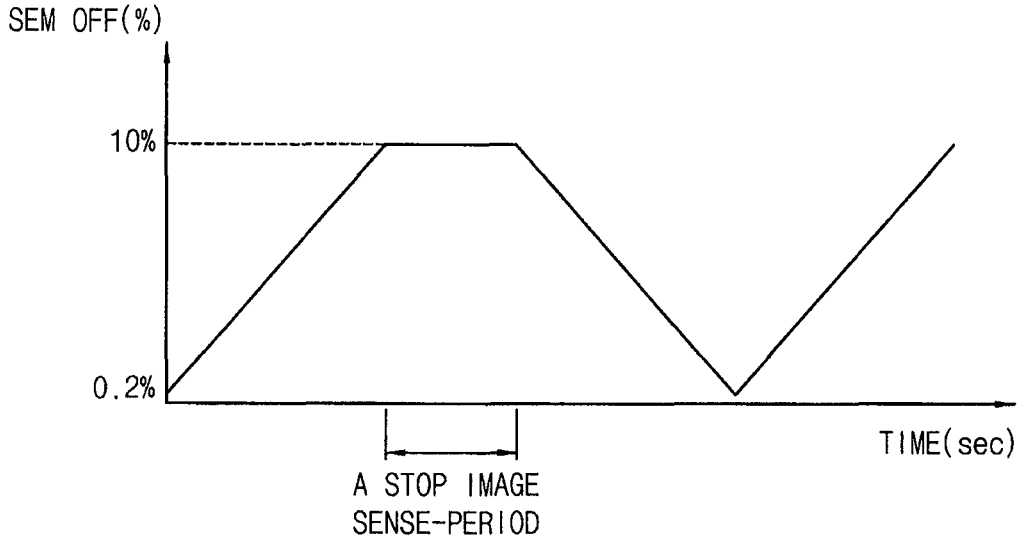
FIG. 11 is a waveform diagram illustrating an example of a stopped image-section in accordance with an example embodiment of the present invention.

FIG. 11 is a waveform diagram illustrating an example of a stopped image-section in accordance with an example embodiment of the present invention.

Referring to FIG. 11, an organic light emitting diode (OLED) display device 100 may further include a frame memory unit and a stop image sensing unit. The frame memory unit may store frame data. The stop image sensing unit may determine whether or not the frame data that is stored in the frame memory unit represent a stop image. When the stop image sensing unit determines that the frame data displays the stop image, the off-period of an emission control signal SEM(n) may be maintained at the maximum off-period. While the off-period is maintained at the maximum off-period, a decrease of the off-period and an increase of the off-period may be periodically repeated when the stop image sensing unit determines that the frame data does not display the stop image (e.g., a moving image). For example, a third timing control signal CTL3 may control the emission driving unit 150 such that an off-period of the emission control signal SEM(n) may be gradually increased and gradually decreased every set or predetermined number of frames. In other word, the third timing control signal CTL3 may control the emission driving unit 150 to change an off-period of the emission control signal each time a set or predetermined number of image frames are displayed such that the off-period of the emission control signal is gradually changed. In addition, an increase of the off-period and a decrease of the off-period may be periodically repeated. In some example embodiments, the emission control signal SEM(n) may include the off-period. During the off-period, pixels PX may be maintained at an off state (e.g., turned off). For example, the off-period (e.g., an off duty ratio) may be determined according to a luminance mode of the OLED display device 100 (e.g., a low luminance mode, a middle luminance mode, and a high luminance mode). Here, when the OLED display device 100 is the high luminance mode, the off-period of the high luminance mode may be less than that of the low or middle luminance mode. For example, when the off-period becomes longer in the high luminance mode, a user of the OLED display device 100 may sense a luminance change. Thus, the off-period in the high luminance mode may have a fixed value (e.g., a predetermined fixed value) of about 0.1% to about 0.3%. The fixed value may be an amount of time that it takes to reset a voltage of a gate electrode of a first transistor TR1 to an initial voltage VINT after the initial voltage VINT is applied to the gate electrode of the first transistor TR1.

When the OLED display device 100, according to some example embodiments, is the high luminance mode, the off-period of the emission control signal SEM(n) based on the third timing control signal CTL3 may be maintained at 0.2% of 1 frame during one second (e.g., a minimum off-period). The third timing control signal CTL3 may gradually increase the off-period of the emission control signal SEM(n) by 1% per 1 second (e.g., linearly increase the off-period over time). However, in an initial act, it is increased by 0.8% per 1 second (e.g., increase from 0.2% to 1%). The third timing control signal CTL3 may gradually increase the off-period of the emission control signal SEM (n) up to 10% over 10 seconds (e.g., during 10 seconds). Here, when the off-period is increased to 10%, the off-period may be defined as a maximum off-period. For example, the maximum off-period may be determined by the user of the OLED display device 100 such that a momentary residual image is not sensed (e.g., perceived) by the user. Here, when the off-period reaches the maximum off-period, the stop image sensing unit may determine whether or not the frame data that is stored in a frame memory unit represent a stop image. When successive frame data do not display the stop image in the frame memory unit, the stop image sensing unit may not work. When the stop image sensing unit determines that the frame data stored in the frame memory unit displays the stop image, the off-period of the emission control signal may be maintained at the maximum off-period (e.g., the off-period is maintained at 10%). However, when a time that the off-period is maintained at the maximum off-period becomes longer, an average luminance of the OLED display device 100 may be reduced, and then the luminance change may be sensed by the user of the OLED display device 100. Thus, the additional function of the OLED display device 100 may be utilized when the time that the off-period is maintained at the stop image is very short. That is, the stop image sensing unit may be selectively used (e.g., utilized) by the user of the OLED display device 100. While the off-period is maintained at the maximum off-period, the third timing control signal CTL3 may gradually decrease the off-period of the emission control signal SEM(n) by 1% per 1 second (e.g., linearly decrease the off-period over time) when the stop image sensing unit determines that the frame data stored in the frame memory unit does not display the stop image. However, in a last step, it is decreased by 0.8% per 1 second (e.g., decrease from 1% to 0.2%). In some example embodiments, during 1 frame, the off-period is not decreased from the maximum off-period (e.g., 10%) to 9%. A decrease of the off-period is performed in a porch-period (e.g., a period that adjusts a frame sync between frames) of a next vertical synchronized (VSYNC) signal. The third timing control signal CTL3 may gradually decrease the off-period of the emission control signal SEM(n) up to 0.2% over 10 seconds. Here, when the off-period is decreased to 0.2%, the off-period may be defined as the minimum off-period. An increase of the off-period and a decrease of the off-period may be periodically repeated until the stop image sensing unit determines that the frame data stored in the frame memory unit displays the stop image.

In some example embodiments, a cycle (e.g., a period) of the third timing control signal CTL3 controlling an increase and a decrease of the off-period may be 20 seconds (i.e., corresponding to 0.05 Hz) except a stop image sense-period. When the off-period is gradually increased and gradually decreased every set or predetermined number of frames, each of the gradual increase and the gradual decrease of the off-period may be 10 seconds. For example, the cycle of the third timing control signal CTL3 may be a very low frequency (VLF) or an infrasonic (e.g., the VLF is below 1 Hz). When the cycle of the third timing control signal CTL3 is the VLF (i.e., when the increase and the decrease of the off-period is performed in the VLF), the user of the OLED display device 100 may not sense a luminance change according to the increase and the decrease of the off-period. Thus, in the high luminance mode, as the off-period is gradually increased and gradually decreased every set or predetermined number of frames, an electric power consumption of the OLED display device 100 may be decreased in the high luminance mode. In addition, as the off-period is maintained at the maximum off-period during the stop image sense-period an electric power consumption of the OLED display device 100 may be decreased in the high luminance mode.

Figure 12:
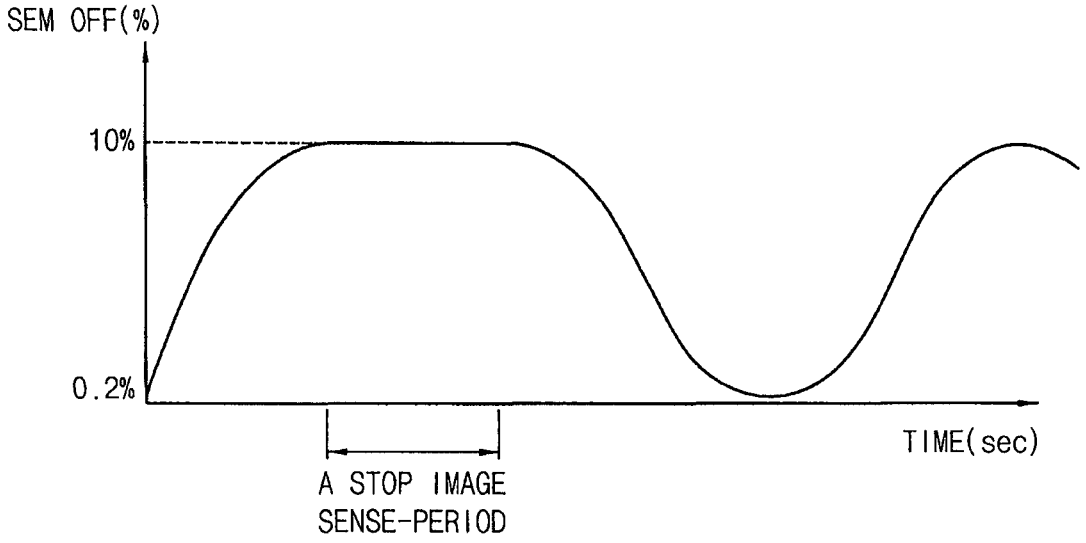
FIG. 12 is a waveform diagram illustrating an example of a stopped image-section in accordance with an example embodiment of the present invention.

FIG. 12 is a waveform diagram illustrating an example of a stopped image-section in accordance with an example embodiment of the present invention.

Referring to FIG. 12, an organic light emitting diode (OLED) display device 100 may further include a frame memory unit and a stop image sensing unit. The frame memory unit may store frame data. The stop image sensing unit may determine whether or not the frame data that is stored in the frame memory unit represent a stop image. When the stop image sensing unit determines that the frame data displays the stop image, the off-period of an emission control signal SEM(n) may be maintained at the maximum off-period. While the off-period is maintained at the maximum off-period, a decrease of the off-period and an increase of the off-period may be periodically repeated when the stop image sensing unit determines that the frame data does not represent the stop image (and, e.g., represents a moving image). For example, a third timing control signal CTL3 may gradually increase and gradually decrease the off-period of the emission control signal SEM(n). An increase of the off-period and a decrease of the off-period may be periodically repeated.

When the OLED display device 100, according to some example embodiments, is in the high luminance mode, the off-period of the emission control signal SEM(n) based on the third timing control signal CTL3 may be maintained at 0.2% of 1 frame during one second (e.g., a minimum off-period). The third timing control signal CTL3 may non-linearly increase the off-period of the emission control signal SEM(n) by 1% per 1 second. For example, when the third timing control signal CTL3 increases the off-period of emission control signal SEM(n) up to 10% over 10 seconds, the off-period may be sharply increased from 1 to 5 seconds, and then the off-period may be gradually increased from 6 to 10 seconds (e.g., the change in the off-period may follow a shape of a Gaussian graph). Here, when the off-period is increased to 10%, the off-period may be defined as a maximum off-period. For example, the maximum off-period may be determined by a user of the OLED display device 100 such that a momentary residual image is not sensed (e.g., perceived) by the user. When the off-period reaches the maximum off-period, the third timing control signal CTL3 may non-linearly decrease the off-period of the emission control signal SEM(n) over time. The third timing control signal CTL3 may gradually decrease the off-period of the emission control signal SEM(n) up to 0.2% over 10 seconds (e.g., during 10 seconds). Here, when the off-period is decreased to 0.2%, the off-period may be defined as the minimum off-period. The stop image sensing unit may determine whether or not the frame data that is stored in a frame memory unit represent a stop image. When successive frame data do not display the stop image in the frame memory unit, the stop image sensing unit may not work. When the stop image sensing unit determines that the frame data stored in the frame memory unit displays the stop image, the off-period of the emission control signal may be maintained at the maximum off-period (e.g., the off-period is maintained as 10%). However, when a time that the off-period the off-period is maintained at the maximum off-period becomes longer, an average luminance of the OLED display device 100 may be reduced, and then the luminance change may be sensed by the user of the OLED display device 100. Thus, the additional function of the OLED display device 100 may be used when the time that the off-period is maintained as the stop image is very short. That is, the stop image sensing unit may be selectively used by the user of the OLED display device 100. While the off-period is maintained at the maximum off-period, the third timing control signal CTL3 may non-linearly decrease the off-period of the emission control signal SEM(n) over time when the stop image sensing unit determines that the frame data stored in the frame memory unit does not display the stop image. The third timing control signal CTL3 may non-linearly decrease the off-period of the emission control signal SEM(n) up to 0.2% over 10 seconds. In some example embodiments, during 1 frame, the off-period is not decreased from the maximum off-period (e.g., 10%) to 9%. A decrease of the off-period is performed in a porch-period of a next vertical synchronized (VSYNC) signal (e.g., a period that adjusts a frame sync between frames). The third timing control signal CTL3 may gradually decrease the off-period of the emission control signal SEM(n) up to 0.2% over 10 seconds. Here, when the off-period is decreased to 0.2%, the off-period may be defined as the minimum off-period. An increase of the off-period and a decrease of the off-period may be periodically repeated until the stop image sensing unit determines that the frame data stored in the frame memory unit displays the stop image.

As described above, in the high luminance mode, as the off-period is gradually increased and gradually decreased every set or predetermined number of frames, an electric power consumption of the OLED display device 100 may be decreased in the high luminance mode. In addition, as the off-period is maintained at the maximum off-period during the stop image sense-period an electric power consumption of the OLED display device 100 may be decreased in the high luminance mode.

Figure 13:
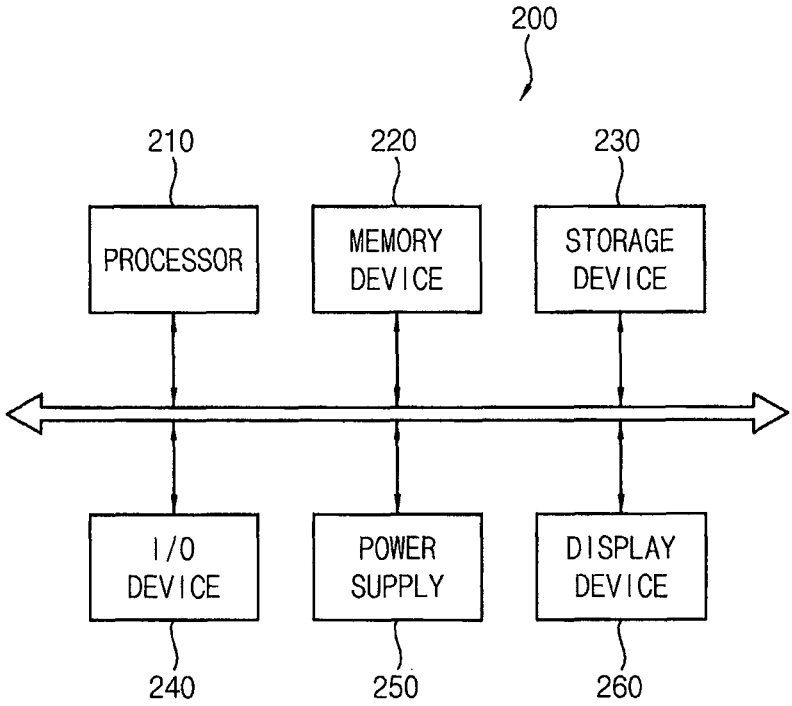
FIG. 13 is a block diagram illustrating an electronic device having a display device in accordance with an example embodiment of the present invention.
Figure 14:
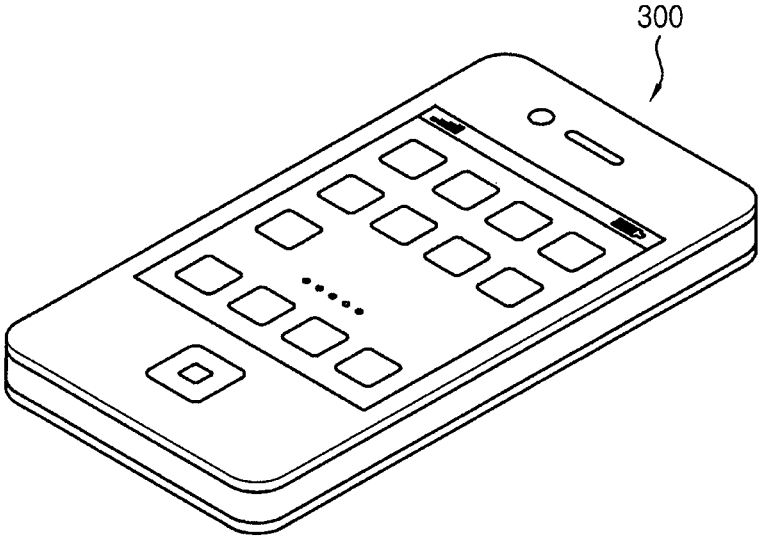
FIG. 14 is a diagram illustrating an example in which the electronic device of FIG. 13 is implemented as a smartphone, according to an example embodiment of the present invention.

FIG. 13 is a block diagram illustrating an electronic device having a display device in accordance with an example embodiment of the present invention. FIG. 14 is a diagram illustrating an example in which the electronic device of FIG. 13 is implemented as a smart-phone, according to an example embodiment of the present invention.

Referring to FIGS. 13 and 14, an electronic device 200 may include a processor 210, a memory device 220, a storage device 230, an input/output (I/O) device 240, a power supply 250, and an organic light emitting display device 260. Here, the electronic device 200 may further include a plurality of ports for communicating a video card, a sound card, a memory card, a universal serial bus (USB) device, other electronic devices, etc. Although it is illustrated in FIG. 12 that the electronic device 200 is implemented as a smart-phone 300, the type of (e.g., the kind of) the electronic device 200 is not limited thereto.

The processor 210 may perform various computing functions. The processor 210 may be a microprocessor, a central processing unit (CPU), or the like. The processor 210 may be coupled to other components via an address bus, a control bus, a data bus, or the like. Further, the processor 210 may be coupled to an extended bus such as a peripheral component interconnection (PCI) bus.

The memory device 220 may store data for operations of the electronic device 200. For example, the memory device 220 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc.

The storage device 230 may be a solid state drive (SSD) device, a hard disk drive (HDD) device, a CD-ROM device, etc. The I/O device 240 may be an input device such as a keyboard, a keypad, a touchpad, a touch-screen, a mouse, etc, and an output device such as a printer, a speaker, etc. The power supply 250 may provide (e.g., supply) a power for operations of the electronic device 200. The organic light emitting display device 260 may communicate with other components via the buses or other communication links.

The organic light emitting display device 260 may correspond to the organic light emitting diode (OLED) display device 100 of FIG. 1 that may include the pixel circuit of FIG. 2, the timing control unit having the third timing control signal CTL3 of FIGS. 4 and 5, and the emission driving unit having increasing and decreasing emission control signals SEM(n) of FIG. 9. Therefore, in the high luminance mode, as the organic light emitting display device 260 gradually increases and gradually decreases the off-period of the emission control signal SEM(n) every set or predetermined number of frames, an electric power consumption of the OLED display device 260 may be decreased in the high luminance mode.

The example embodiments of the present invention may be applied to any electronic system 200 having the organic light emitting display device 260. For example, the example embodiments may be applied to the electronic system 200, such as a digital or 3D television, a computer monitor, a home appliance, a laptop, a digital camera, a cellular phone, a smart phone, a personal digital assistant (PDA), a portable multimedia player (PMP), a MP3 player, a portable game console, a navigation system, a video phone, etc.

The present invention may be applied to the suitable display device having an emission driving unit. For example, the present may be applied to the mobile phone, the smart phone, the laptop computer, the tablet computer, the personal digital assistant (PDA), the portable multimedia player (PMP), the digital camera, the music player (e.g., a MP3 player), the portable game console, the navigation, etc.

The foregoing is illustrative of some example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The scope of the present invention is defined by the following claims, with equivalents of the claims to be included therein.

What is claimed is:

1. An organic light emitting diode display device comprising:

a display panel comprising a plurality of pixels;

a scan driving unit configured to supply a scan signal to the pixels via a plurality of scan lines;

a data driving unit configured to supply a data signal to the pixels via a plurality of data lines;

an emission driving unit configured to supply an emission control signal to the pixels via a plurality of emission control lines; and a timing control unit configured to control the scan driving unit, the data driving unit, and the emission driving unit, the timing control unit controlling the emission driving unit to gradually and periodically change a length of time of an off-period of the emission control signal with a fixed period of a number of image frames being displayed, when frame data does not represent a stop image.

2. The device of claim 1, wherein the emission driving unit is configured to gradually increase the off-period of the emission control signal from a minimum off-period to a maximum off-period.

3. The device of claim 2, wherein the emission driving unit is further configured to gradually decrease the off-period of the emission control signal from the maximum off-period to the minimum off-period.

4. The device of claim 3, wherein the emission driving unit is further configured to periodically repeat the gradual increase and the gradual decrease of the off-period of the emission control signal.

5. The device of claim 3, wherein the emission driving unit is further configured to gradually increase and gradually decrease the off-period of the emission control signal when an average luminance of the organic light emitting diode display device is higher than about 200 nit.

6. The device of claim 3, wherein emission driving unit is further configured to perform each of the gradual increase and the gradual decrease of the off-period of the emission control signal for more than about 10 seconds.

7. The device of claim 3, wherein the maximum off-period is below about 10% of one frame time.

8. The device of claim 1, wherein the pixels are configured to sequentially emit light on a row-by-row basis.

9. The device of claim 1, further comprising:

a frame memory unit configured to store the frame data; and a stop image sensing unit configured to determine when the frame data stored in the frame memory unit represent the stop image.

10. The device of claim 9, wherein the emission driving unit is further configured to maintain the off-period of the emission control signal at a maximum off-period, when the stop image sensing unit determines that the frame data represent the stop image.

11. A method of driving an organic light emitting diode display device comprising a plurality of pixels, the method comprising:

generating an emission control signal to allow the pixels to emit light; and gradually and periodically changing a length of time of an off-period of the emission control signal with a fixed period of a number of image frames being displayed, when frame data does not represent a stop image.

12. The method of claim 11, wherein the off-period of the emission control signal is gradually increased from a minimum off-period to a maximum off-period.

13. The method of claim 12, wherein, when the off-period of the emission control signal reaches the maximum off-period, the off-period of the emission control signal is gradually decreased from the maximum off-period to the minimum off-period.

14. The method of claim 13, wherein the gradual increase and the gradual decrease of the off-period of the emission control signal are periodically repeated.

15. The method of claim 13, wherein the gradual increase and the gradual decrease of the off-period of the emission control signal are performed when an average luminance of the organic light emitting diode display device is greater than about 200 nit.

16. The method of claim 13, wherein each of the gradual increase and the gradual decrease of the off-period of the emission control signal is performed for more than about 10 seconds.

17. The method of claim 13, wherein the maximum off-period is below about 10% of one frame time.

18. The method of claim 11, wherein the pixels sequentially emit light on a row-by-row basis.

19. The method of claim 11, further comprising:

storing the frame data in a frame memory unit; and determining, by a stop image sensing unit, when the frame data stored in the frame memory unit represent the stop image.

20. The method of claim 19, wherein, when the stop image sensing unit determines that the frame data represent the stop image, the off-period of the emission control signal is maintained at a maximum off-period.

* * * * *